US006959996B2

(12) United States Patent
Ip

(10) Patent No.: US 6,959,996 B2
(45) Date of Patent: Nov. 1, 2005

(54) LIGHTING APPARATUS WITH CONVENIENT AND CONCEALED MOUNTING MECHANISM AND A SLIP-RESISTANT VERTICAL ADJUSTMENT AND ATTACHMENT/REMOVAL MECHANISM

(76) Inventor: Ken Ip, Rm 3-4, 11/F, Cheung Fat Industrial Building, 64-76 Larch Street, Tai Kok Tsui, Kowloon, Hong Kong, Hong Kong (CN)

( * ) Notice: Subject to any disclaimer, the term of this patent is extended or adjusted under 35 U.S.C. 154(b) by 95 days.

(21) Appl. No.: 10/764,796

(22) Filed: Jan. 26, 2004

(65) Prior Publication Data

US 2005/0162855 A1 Jul. 28, 2005

(51) Int. Cl.[7] ..... A45B 3/02; A63B 15/02

(52) U.S. Cl. ..... 362/102; 362/650; 362/640; 362/418; 362/429; 362/430; 362/431; 362/396; 362/227

(58) Field of Search ..... 362/102, 650, 362/640, 249, 250, 418, 429, 430, 410, 431, 362/396, 97, 134, 227, 368

(56) References Cited

U.S. PATENT DOCUMENTS 2,087,537 A * 7/1937 Finkel ..... 362/102
4,174,532 A * 11/1979 Kelley ..... 362/102
4,225,909 A * 9/1980 Scholz et al. ..... 362/367
5,641,223 A 6/1997 Rustebakke
6,176,598 B1 1/2001 Seligman
2002/0071278 A1 * 6/2002 Lin ..... 362/287

OTHER PUBLICATIONS

Internet webpage for Tidewater Workshop, author unknown, advertisement for "Umbrella Lights", printed Dec. 10, 2003.
Internet webpage for UmbrellaTime.com, author unknown, advertisement for "Umbrella Torches", printed off internet Dec. 10, 2003.
Internet webpage for CatalogCity.com, author unknown, advertisement for "Solar Globe Light Set", printed off internet Dec. 10, 2003.
Internet webpage for Brella Sphere, author unknown, advertisement for the "Brella Sphere", printed off internet Dec. 10, 2003.

* cited by examiner

*Primary Examiner*—Sandra O'Shea
*Assistant Examiner*—Sharon Payne
(74) *Attorney, Agent, or Firm*—Eric Hanscom

(57) ABSTRACT

The present invention is directed to a lighting apparatus to be used on an umbrella pole or similar upright structure with a convenient and concealed mounting mechanism and a slip-resistant vertical adjustment mechanism, designed to provide the user with an easily adjustable and removable/attachable source of light, wherein the means by which it is removed or attached is attractively concealed from the casual observer.

2 Claims, 9 Drawing Sheets

LIGHTING APPARATUS WITH CONVENIENT AND CONCEALED MOUNTING MECHANISM AND A SLIP-RESISTANT VERTICAL ADJUSTMENT AND ATTACHMENT/REMOVAL MECHANISM

CROSS REFERENCE TO RELATED APPLICATIONS

None

STATEMENT REGARDING FEDERALLY SPONSORED RESEARCH OR DEVELOPMENT

This invention was not federally sponsored.

BACKGROUND OF INVENTION

Umbrellas have been part of human society for over four thousand years. There is evidence of umbrellas in the ancient art and artifacts of Egypt, Assyria, Greece, and China. These ancient umbrellas or parasols were first designed to provide shade from the sun. The Chinese were the first to waterproof their umbrellas for use as rain protection. They waxed and lacquered their paper parasols in order to use them for rain.

Starting in the 16th century umbrella became popular to the western world, especially in the rainy weather of northern Europe. The early European umbrellas were made of wood or whalebone and covered with alpaca or oiled canvas. The artisans made the curved handles for the umbrellas out of hard woods like ebony, and were well paid for their efforts.

In 1852, Samuel Fox invented the steel ribbed umbrella design. Fox also founded the "English Steels Company", and claimed to have invented the steel ribbed umbrella as a way of using up stocks of farthingale stays, steel stays used in women's corsets. American inventor William C. Carter patented an umbrella stand (U.S. Pat. No. 323,397) on Aug. 8, 1885. After that, compact collapsible umbrellas were the next major technical innovation in umbrella manufacture, over a century later.

With patio use by homeowners becoming more popular over the past several decades, there has been a corresponding increase in the number and variety of patio furniture and accessories. One such accessory has been lights which attach to umbrella poles.

While there is a relative dearth of patents directly on this invention, there are several commercially manufactured umbrella lights being sold as of the date of this application, including products sold on internet sites known by generic terms such as "umbrella lights" and "umbrella torches". While all of these products provide some combination of lighting, a means of attachment to the umbrella pole through an "attachment ring" which partially or entirely encircles the umbrella pole, and a means of adjustment up and down the umbrella pole, none combine the ease and concealed nature of the means of attachment with the security and ease of adjustment up and down the umbrella that is provided by this invention.

One key improvement of this invention is that the "attachment ring" of the light device, which fits around the umbrella pole, has a removable section which can be taken out to allow the invention to quickly and easily be slid up against and around the umbrella pole. This invention also has a screw-tightened "V" of plastic covered by a slip-resistant plastic cover which enhances the lighting device's ability to maintain its vertical position on the umbrella stand by providing a variable amount of pressure on the umbrella pole.

The marketing term "umbrella lights" refers to two basic models. The first consists of a series of small lights which are wound around the ribs of the umbrella, and are powered by a direct power source or battery. This product provides lighting but is neither adjustable nor easily attached and detached from the umbrella pole, as is the current invention. The second version of "umbrella lights" operate in a similar fashion to the "umbrella torches", and refer to an attachment ring from which protrudes one or more lights, the stand fitting around the umbrella stand and being attached to it through a variety of mechanisms. This product provides light, and offers a means of attachment to the umbrella pole and a means of adjustment up and down the umbrella pole, but neither conceals the means of attachment nor offers as secure a means of attaching the stand to the umbrella pole as this invention.

The prior art discloses a number of inventions which use the underside of an umbrella, sometimes with a reflective coating, to direct light in a diffused pattern toward a photographic object or for other uses. For example, U.S. Pat. No. 6,176,598 by Seligman, et. al. teaches a light fixture flexible reflector which directs light through a diffuser, U.S. Pat. No. 5,641,223 by Rustebakke teaches a horticulture lamp where the umbrella shade reflects light onto growing plants. Neither invention has the adjustable feature contained in this invention, nor do they have a light which detaches from the umbrella pole.

Accordingly, there is a long felt need for a simple, economical, device that can allow a lighting apparatus to be attached to an umbrella pole or other similar upright device in a manner which is attractive—with the method of attachment effectively concealed from view—and yet allows the lighting apparatus to be attached, removed, and adjusted quickly and easily. The present invention is directed to a lighting apparatus to be used on an umbrella pole or similar upright structure with a convenient and concealed mounting mechanism and a slip-resistant vertical adjustment mechanism, designed to provide the user with an easily adjustable and removable/attachable source of light, wherein the means by which it is removed or attached is attractively concealed from the casual observer.

BRIEF SUMMARY OF INVENTION

It is therefore an object of this invention to provide a means of attaching one or more lights to an umbrella pole or similar structure in an efficient and easily adjustable fashion.

It is a further object of this invention to provide a means by which the lighting device can be manually tightened so as to not slip down the pole.

It is a further object of this invention that a the lighting device can be quickly and easily attached to and removed from a pole without having to disassemble the umbrella or other pole device so that the lighting device can be slid over either end of the pole, but rather be designed such that a hidden section of the attachment ring encircling the pole can be removed to either attach or remove the lighting device, after which the hidden section can be quickly and easily reattached to the lighting device and its detachability hidden as it fits back into the lighting device with barely visible seams between it and the rest of the lighting device.

Other and further objects and features of this invention will be apparent to one skilled in the art.

DETAILED DESCRIPTION OF THE INVENTION

The present invention is directed to a lighting apparatus with convenient and concealed mounting mechanism and a slip-resistant vertical adjustment and attachment/removal mechanism.

Figure 1:
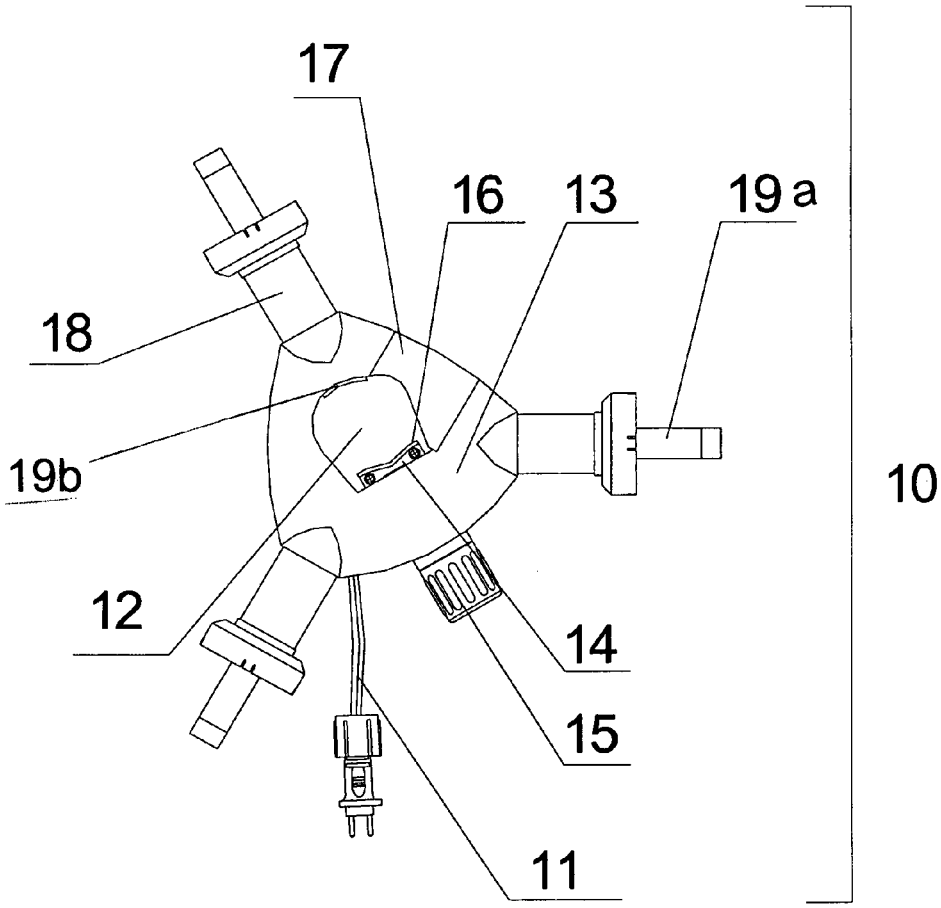
FIG. 1 is a top view of the invention showing its basic components.
Figure 2:
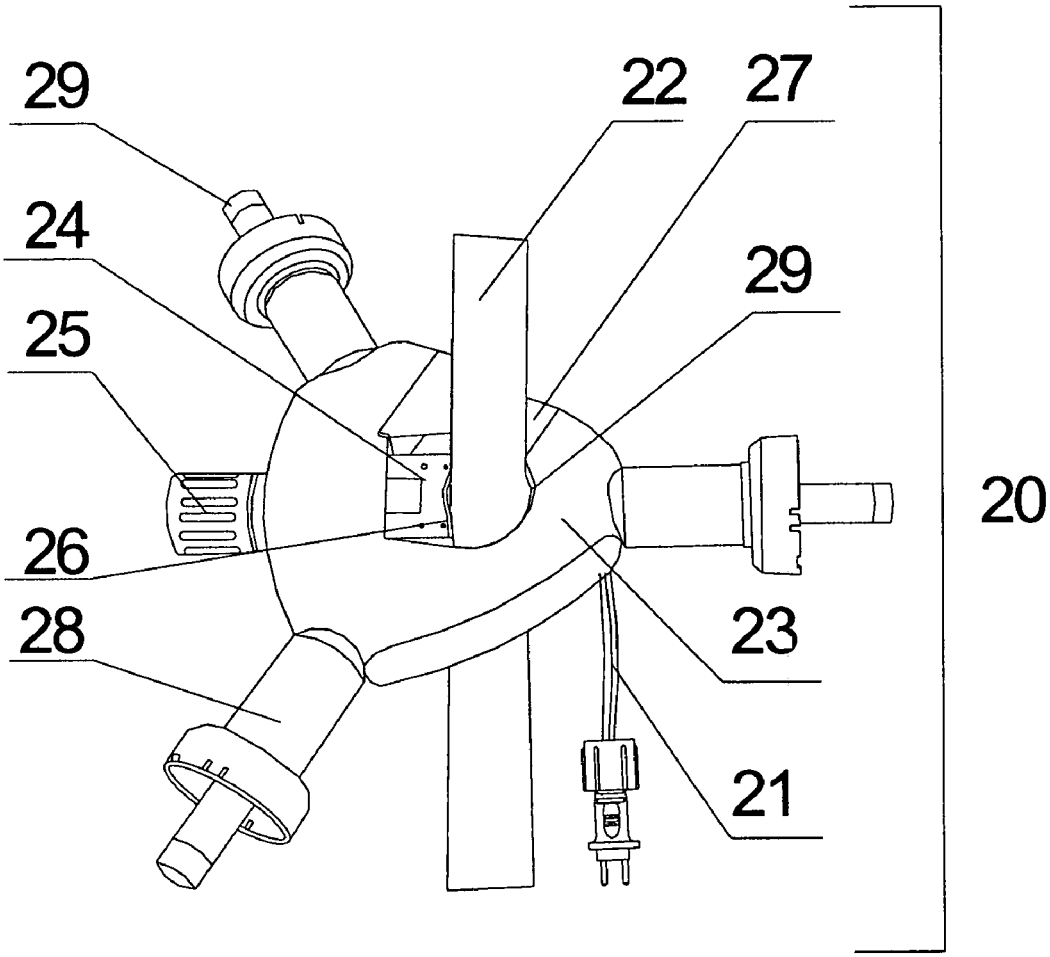
FIG. 2 is a partial elevational view of the invention attached to an umbrella pole.

Referring to the drawings, and particularly to FIG. 1 and FIG. 2, the invention consists of a lighting device which can be easily attached or removed from an umbrella pole or other similar structure. The best mode of this invention is its use for providing light via its attachment to an umbrella pole and this mode will be used as the example throughout this application. It is understood by the inventor and intended to be shown through this application that the same device can be used with a number of other upright pole-like structures, including but not limited to fence poles, flap poles, wrought iron and similar pieces of metal or wood used to make gates and fences, and other structures which will be clear to one practiced in the art.

Referring specifically to FIG. 1, the invention (generally indicated by reference number 10) has several basic components. An electrical cord (11) attaches to a power cord or outlet (not shown) to supply power to the lighting device (10). The lighting device (10) attaches to the umbrella pole (not shown) by having an encircling band (13) encircle the umbrella pole (not shown in this figure), which fits through the umbrella opening (12). The invention (10) is held in place by a tightening block (14), which is tightened by screws (not shown in this figure) controlled by the adjusting handle (15). At the end of the tightening block (14) closest to the umbrella opening (12) the tightening block (14) is covered with a thin layer of slip-resistant plastic (16), shaped in a low-angle "V", such that once the lighting device (10) is tightened, it will not slide down the umbrella pole. On the opposite side of the umbrella opening (12) from the tightening block (14) is a bracing layer of slip-resistant plastic (19*b*) against which the umbrella pole (not shown in this figure) is braced by pressure supplied by the tightening block (14). Along one side of the encircling band (13) is the removable section (17), which is virtually unrecognizable as being removable to the casual observer, as it nearly seamlessly blends in with the rest of the encircling band (13). Extending outward from the encircling bank (13) are (in this iteration of the invention) three light fixture extenders (18), which terminate in light fixtures (19*a*) into which light bulbs can be screwed to provide light.

Referring to FIG. 2, the invention (generally indicated by reference number 20) has several basic components. An electrical cord (21) attaches to a power cord or outlet (not shown) to supply power to the lighting device (20). The lighting device (20) attaches to the umbrella pole (22) by having an encircling band (23) encircle the umbrella pole (22). The invention (20) is held in place by a tightening block (24), which is tightened by screws (not shown in this figure) controlled by the adjusting handle (25). At the end of the tightening block (24) closest to the umbrella pole (22) the tightening block (24) is covered with thin layer of slip-resistant plastic (26), such that once the lighting device (20) is tightened up against the bracing layer of slip-resistant plastic (29), it will not slide down the umbrella pole (22). Along one side of the encircling band (23) is the removable section (27), which is virtually unrecognizable as being removable to the casual observer, as it nearly seamlessly blends in with the rest of the encircling band (23). Extending outward from the encircling bank (23) are (in this iteration of the invention) three light fixture extenders (28), which terminate in light fixtures (29) into which light bulbs can be screwed to provide light.

Figure 3:
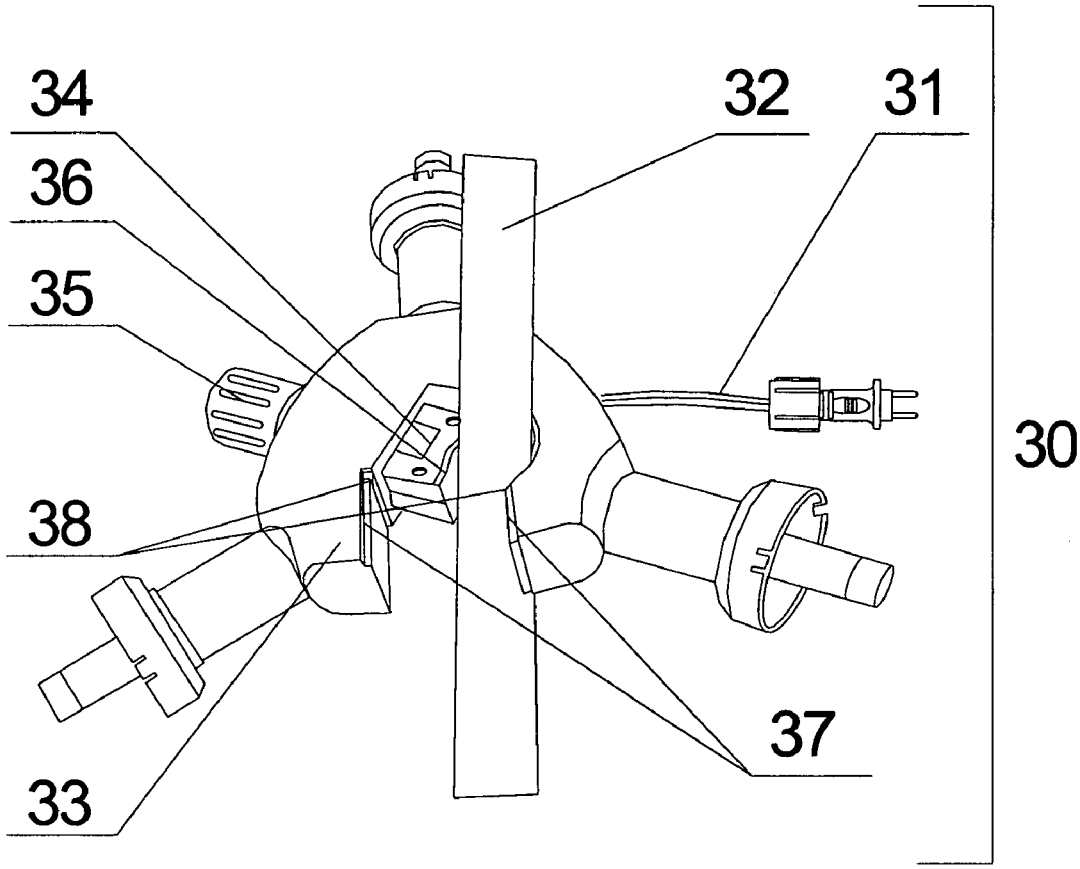
FIG. 3 is an elevational view of the invention attached to an umbrella pole, showing the removable section of the encircling ring detached, but with the tightening mechanism apply pressure to keep the lighting device fixed at its current elevation on the umbrella pole.

FIG. 3 shows an elevational, side view of an iteration of the invention (generally indicated by reference number 30). An electrical cord (31) attaches to a power cord or outlet (not shown) to supply power to the lighting device (30). The lighting device (30) attaches to the umbrella pole (32) by having an encircling band (33) encircle the umbrella pole (32). The invention (30) is held in place by a tightening block (34), which is tightened by screws (not shown in this figure) controlled by the adjusting handle (35). At the end of the tightening block (34) closest to the umbrella pole (32) the tightening block (34) is covered with thin layer of slip-resistant plastic (36), such that once the lighting device (30) is tightened, it will not slide down the umbrella pole (32). Along one side of the encircling band (33) the removable section (not shown in this figure), has been removed, to show the attachment tracks (37) built into the encircling ring (33) onto which the removable section (not shown in this figure) can slide to be secured, with attachment cavities (38) built into the encircling ring (33) at the end of the attachment tracks (37) closest to the umbrella pole (32).

Figure 4:
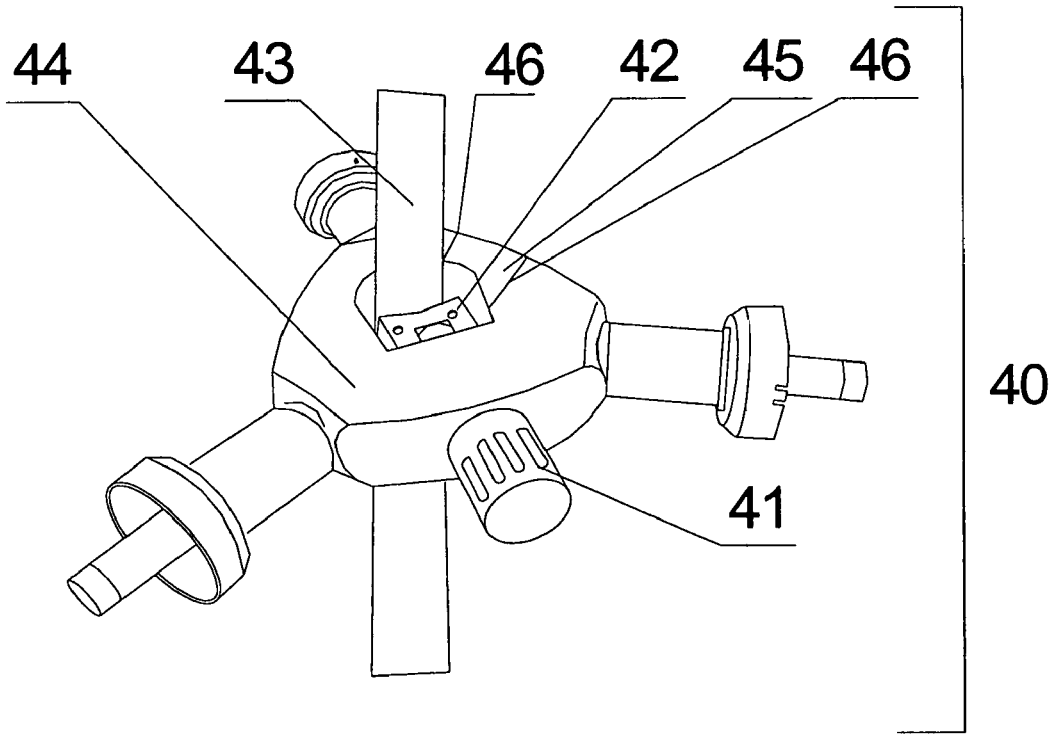
FIG. 4 is an elevational back view of the invention, showing the tightening handle.

FIG. 4 is an elevational view of the "back" side of the invention, generally indicated by reference number 40). The adjustment handle (41) is used manually to adjust the tightening block (42) in or out, to increase or decrease pressure exerted on the umbrella pole (43). The tightening block (42) pushes the umbrella pole (43) against the encircling band (44), which is show here with the removable section (45) attached, illustrating how the seams (46) between the removable section (45) and the encircling band (44) are effectively concealed by the design of the invention.

Figure 5:
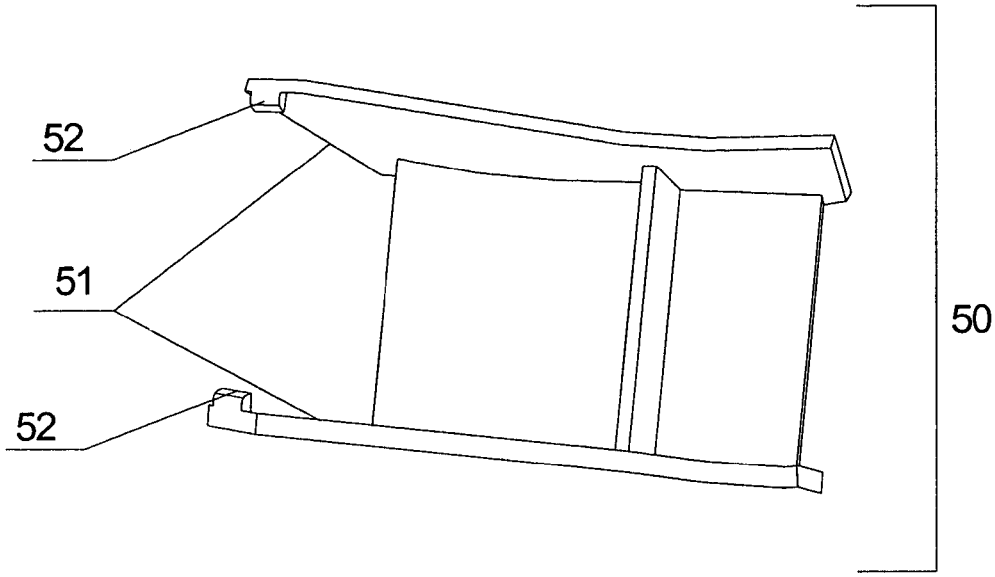
FIG. 5 is an elevational view of the removable section, showing the end clips which allow it to snap into place on the encircling ring with barely visible seams, thus concealing its function to the casual observer and enhancing the attractiveness of the invention.

FIG. 5 is an elevational view of the removable section (generally indicated by reference number 50), showing the attachment ridge (51) which slides along the attachment tracks (not shown in this illustration) built into the encircling band (not show in this illustration), and the attachment clips (52) which snap the removable section (50) into the encircling band by fitting into attachment cavities (not shown in this figure) built into the encircling band (not show in this figure).

Figure 6:
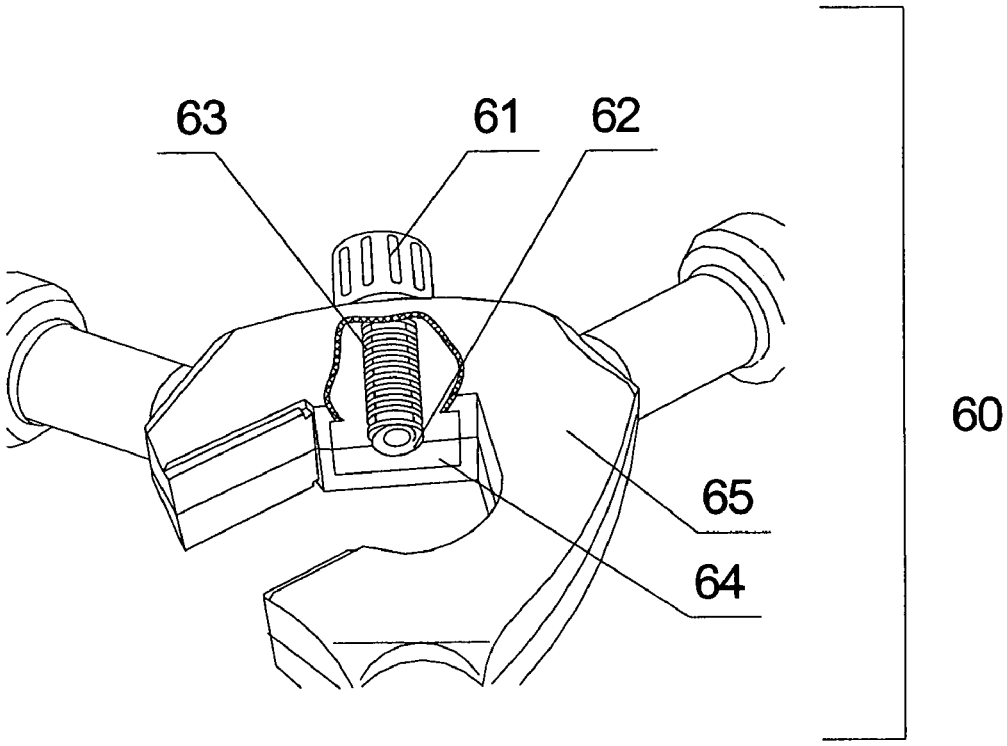
FIG. 6 is a partial elevational view of the attachment ring with the removable section removed, and the tightening block also removed, showing the internal screw threads in both the screw threads coming off the adjusting handle and the screw threads internal the tightening block.

FIG. 6 is a partial elevational view of the invention, showing the detail of the screw driven tightening mechanism (generally indicated by reference number 60). The adjustment handle (61) is connected to, and can turn, a screw body (62) around which are a series of screw threads (63). As the adjustment handle (61) is turned, the screw body (62) rotates, driving out or pulling back, depending on the direction the adjustment handle (61) is turned, the tightening block (not show in this figure) through the block cavity (64), which is built into the encircling ring (65).

Figure 7:
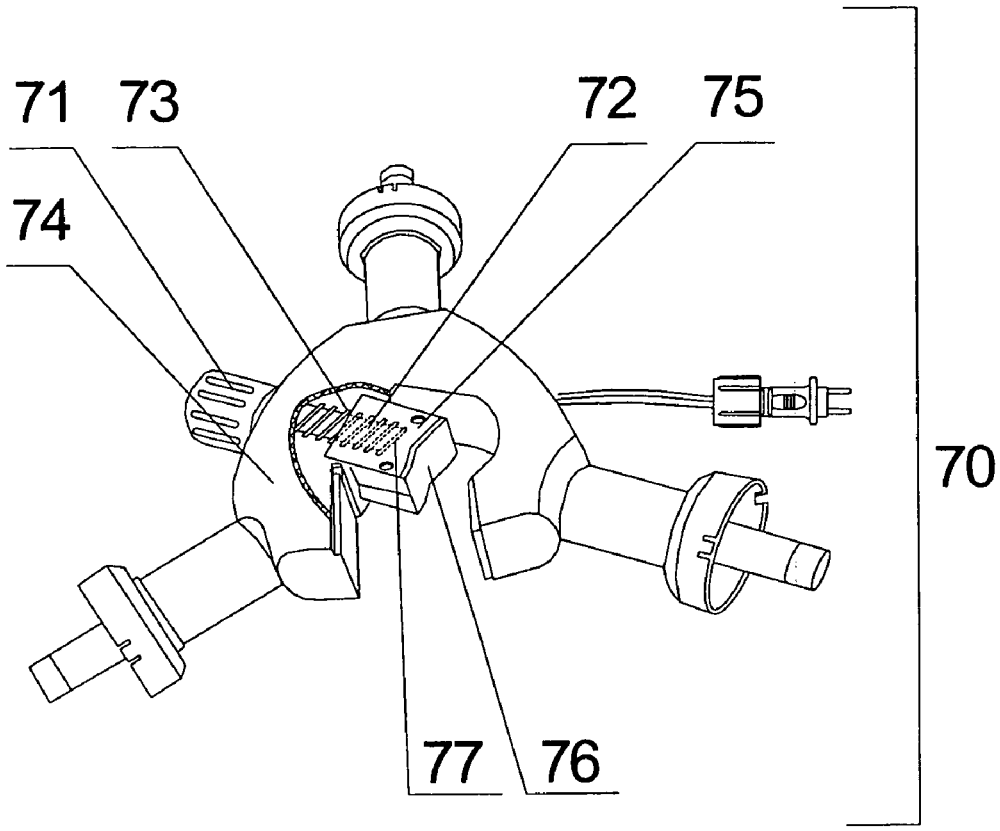
FIG. 7 is a partial top view of the tightening mechanism portion of the attachment ring, showing the tightening block and the handle by which the screw-threaded tightening block is moved forward and backward, and illustrating how the screw threads coming off the adjustment handle mesh with those in the tightening block.

FIG. 7 is a top view showing the functionality of the tightening mechanism (generally indicated by reference number 70). The adjustment handle (71) can be turned by a use to increase or decrease the pressure exerted by the tightening block (75) on the umbrella pole (not shown in this figure). The adjustment handle (71) is attached to a screw body (72) upon which there are a series of screw threads (73) which mesh a series of screw thread countersunk grooves (77) built into the tightening block (75). By turning the adjustment handle (71), the screw body (72) and screw threads (73) pull or push the tightening block (75) into or out of the encircling ring (74), such that the thin layer of slip-resistant plastic (76) can be forced up against the umbrella pole (not shown in this figure) to affix the invention to the pole, or pulled back away to allow the invention to be adjusted up or down the pole, or to be removed.

Figure 8:
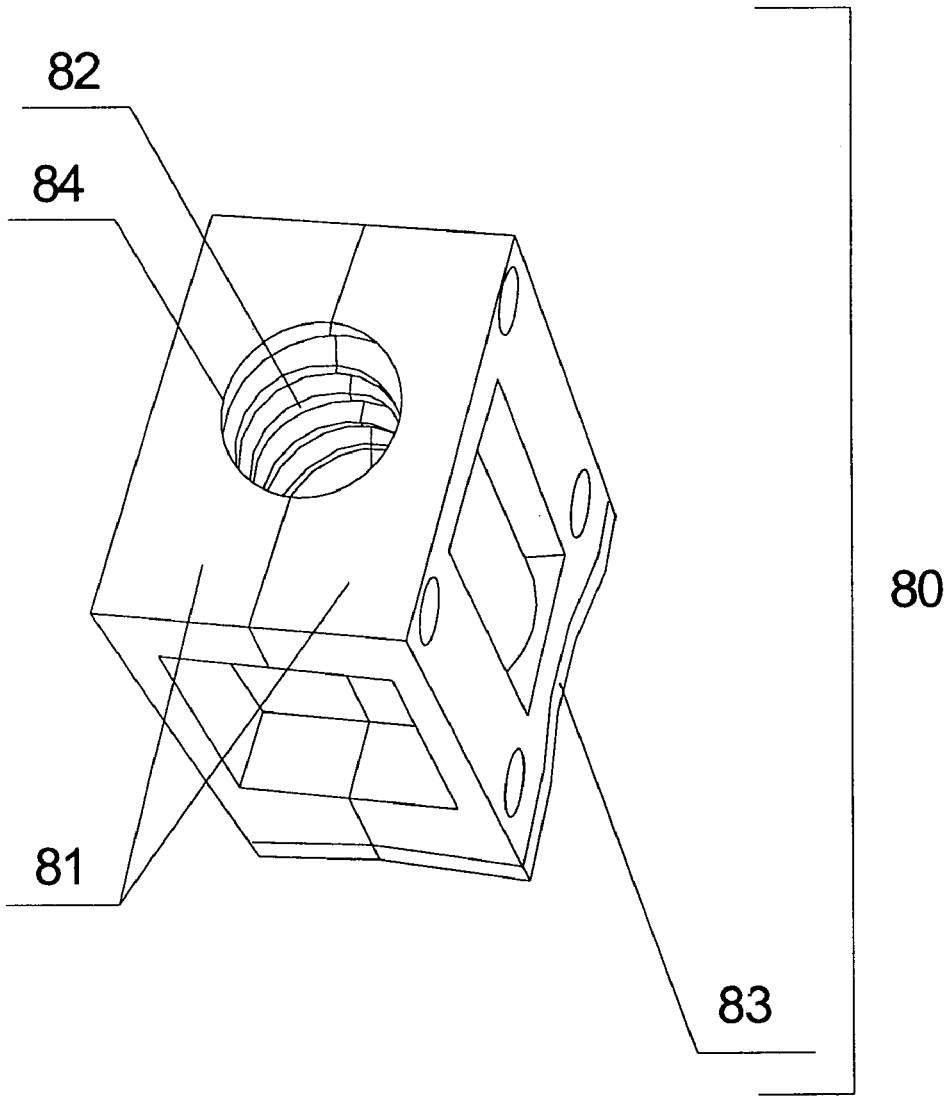
FIG. 8 is a partial elevational view of the tightening block removed from the encircling ring, showing it screw threads and the V-shaped end which is covered with a piece of plastic which is particularly resistant to slippage.

FIG. 8 is a side, elevational view of the tightening block (generally indicated by reference number 80). The tightening block (80) is comprised of two halves (81) into which screw thread countersunk grooves (82) are built into the tightening block (80), such that the screw threads (not shown in this figure) from the adjustment handle (not shown in this figure) mesh and can be used to move the tightening block (80) in either direction. On the end of the tightening block (80) furthest away from the opening to the screw thread countersunk grooves (84) is the thin layer of slip-resistant plastic (83).

Figure 9:
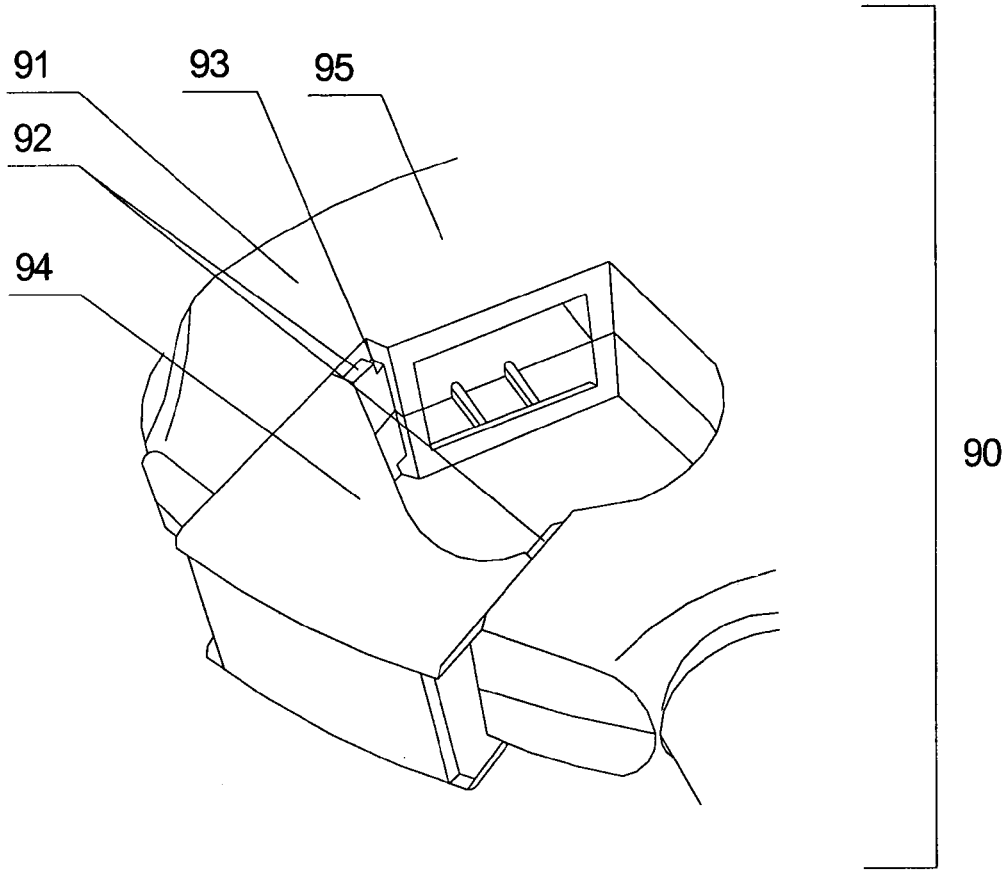
FIG. 9 is a partial elevational view of the interface between the removable section and the encircling ring, showing how the removable section slides into a track built into the encircling ring, and how the attachment clips of the removable section snap into cavities in the encircling ring at the end of the tracks built into the encircling ring.

FIG. 9 is a partial, elevational view of the attachment means of the removable section into the encircling ring (generally indicated by reference number 90). Into the encircling ring (91) are built two attachment tracks (92) with at their ends, attachment cavities (93) into which the attachment clips (95) on the removable section (94) snap into place, securing the removable section (94) into the encircling ring (91).

What is claimed is:

1. An apparatus for attaching a lighting device with one or more light bulbs to an umbrella pole or similar upright device, comprising:

an electrical cord;

one or more light fixtures into which one or more light bulbs and light globes can be attached;

an encircling ring made of plastic, metal, or some other rigid material which encircles the pole; and an adjustment mechanism consisting of an adjustment handle attached to a screw body with screw threads projecting through the encircling ring into screw thread countersunk grooves built into a tightening block, made of the same material as the encircling ring;

wherein the tightening block can be moved forward or backward through the encircling ring by manually twisting the adjustment handle, and;

wherein at the end of the tightening block furthest away from the adjustment handle is a thin layer of slip-resistant plastic which, when tightened up against the umbrella pole or other upright device by applying pressure against the umbrella pole or other upright device against a bracing layer of slip-resistant plastic set on the inner face of the encircling ring on the opposite side of the umbrella opening, provides a non-slip means of maintaining the vertical position of the lighting device without slippage down, and provides a convenient means of adjusting the lighting device up or down the umbrella pole.

2. The apparatus of claim 1, where, the means of attaching the device to and from an umbrella pole or other upright device comprises:

a removable section of the encircling ring designed to appear as a seamlessly integrated part of the ring, wherein;

the removable section is designed to slide into the encircling ring along attachment tracks built into the encircling ring; and at the end of the attachment tracks on the encircling ring closest to the umbrella pole or other upright device are two attachment cavities, into which attachment clips on the removable section snap into place, thereby securing the removable section into the encircling ring in an almost seamless manner by which it appears that the removable section is a part of the encircling ring rather than being a separate unit.

* * * * *